United States Patent [19]

Welsh

[11] 3,932,945

[45] Jan. 20, 1976

[54] DIRECT COOLING OF REDUCED MANGANESE ORE

[75] Inventor: Jay Y. Welsh, Catonsville, Md.

[73] Assignee: Diamond Shamrock Corporation, Cleveland, Ohio

[22] Filed: Nov. 11, 1974

[21] Appl. No.: 522,359

[52] U.S. Cl. ..... 34/20; 34/13; 75/80; 423/49

[51] Int. Cl.[2] ..... F26B 5/00

[58] Field of Search ..... 34/13, 20; 75/80; 423/49

[56] References Cited

UNITED STATES PATENTS 1,826,594 10/1931 Bellone ..... 423/49

3,375,097 3/1968 Welsh ..... 75/80

*Primary Examiner*—John J. Camby

*Attorney, Agent, or Firm*—William A. Skinner

[57] ABSTRACT

Hot reduced manganese ore is cooled by blowing air through a layer of ore at velocities greater than 1 meter per second. The use of an inert cooling gas is unnecessary, and air reoxidation of the ore does not occur in the process.

10 Claims, 2 Drawing Figures

DIRECT COOLING OF REDUCED MANGANESE ORE

FIELD OF THE INVENTION

The present invention relates to pyrometallurgical reduction processes for the recovery of metal values from manganese ore. More particularly the invention is concerned with a process for cooling reduced manganese ore to ambient temperatures without significant reoxidation using a high velocity air blow.

BACKGROUND OF THE INVENTION

In numerous applications it is essential to reduce the manganese values in manganese ore to manganous oxide (MnO), and to recover the reduced ore in dry, stable form. Such ore reduction is generally carried out at temperatures in excess of 760°C. (1400°F.), normally at about 843° to 954°C. (1550° to 1750°F.). It is then necessary to cool the hot reduced ore, without reoxidation, to near room temperature, and desirably to less than 38°C. (100°F.).

Cooling of reduced ore has generally been accomplished in the presence of an inert gas, i.e., a gas which is non-oxidizing towards MnO. Even the most stable MnO has not been handled in a system open to the atmosphere unless it was first cooled to a temperature below about 120°C. (248°F.). This temperature reduction has generally been carried out either by indirect cooling in a kiln containing an inert or reducing atmosphere, or by forcing an inert gas through the reduced ore.

When reduced ore is introduced into an indirectly cooled kiln at 843° to 954°C. (1550° to 1750°F.), very rapid cooling takes place until the ore reaches a temperature of about 230°C. (446°F.). As the ore reaches this intermediate temperature, the rate of cooling becomes markedly slower. This is particularly true of ore which has a relatively coarse particle size. If the ore has been crushed rather than milled prior to reduction, kiln cooling is undesirably slow.

SUMMARY OF THE INVENTION

It has been discovered that hot reduced manganese ore can be rapidly cooled to room temperature without significant reoxidation by the application of a suitably controlled air quenching process. The process comprises blowing air through a layer of hot reduced ore at a velocity of at least 1 meter (3.3 feet) per second until the ore reaches the desired temperature. Cooling by an air blow of the proper velocity is particularly suitable for use on crushed, unground ore which has been reduced and then brought to an intermediate temperature by indirect kiln cooling.

The process of the invention has numerous advantages, including rapid cooling without the use of expensive inert atmospheres and related complex equipment, avoidance of reoxidation upon exposure to air, and the use of simple and small equipment. A further advantage is realized when the air blow cooling process is combined with an indirect kiln cooling process. The discharge temperature of reduced ore from the kiln can be raised, for example from 50°C. (122°F.), to 120°C. (248°F.), which permits the through-put of the kiln to be increased over twofold. The reduced ore discharged from the kiln at this intermediate temperature may then be rapidly cooled by the air blow process, without reoxidation.

BRIEF DESCRIPTION OF THE DRAWINGS

The followng discussion will refer to the drawings, in which.

DESCRIPTION OF THE PREFERRED EMBODIMENTS

The air quenching process basically comprises blowing air through a layer of hot, reduced manganese ore at a velocity of at least one meter (3.3 feet) per second until the ore has reached the desired temperature. More specifically the process involves the cooling of unground, reduced manganese ore from the temperature range 90°–230°C. (194°–446°F.), to the range 25°–65°C. (77°–149°F.), by spreading the hot reduced ore in a layer up to about 5 cm. (2 inches) in thickness, and blowing cooler air through the ore layer at a velocity of at least 1 meter per second until all of the ore has reached the desired temperature.

Figure 1:
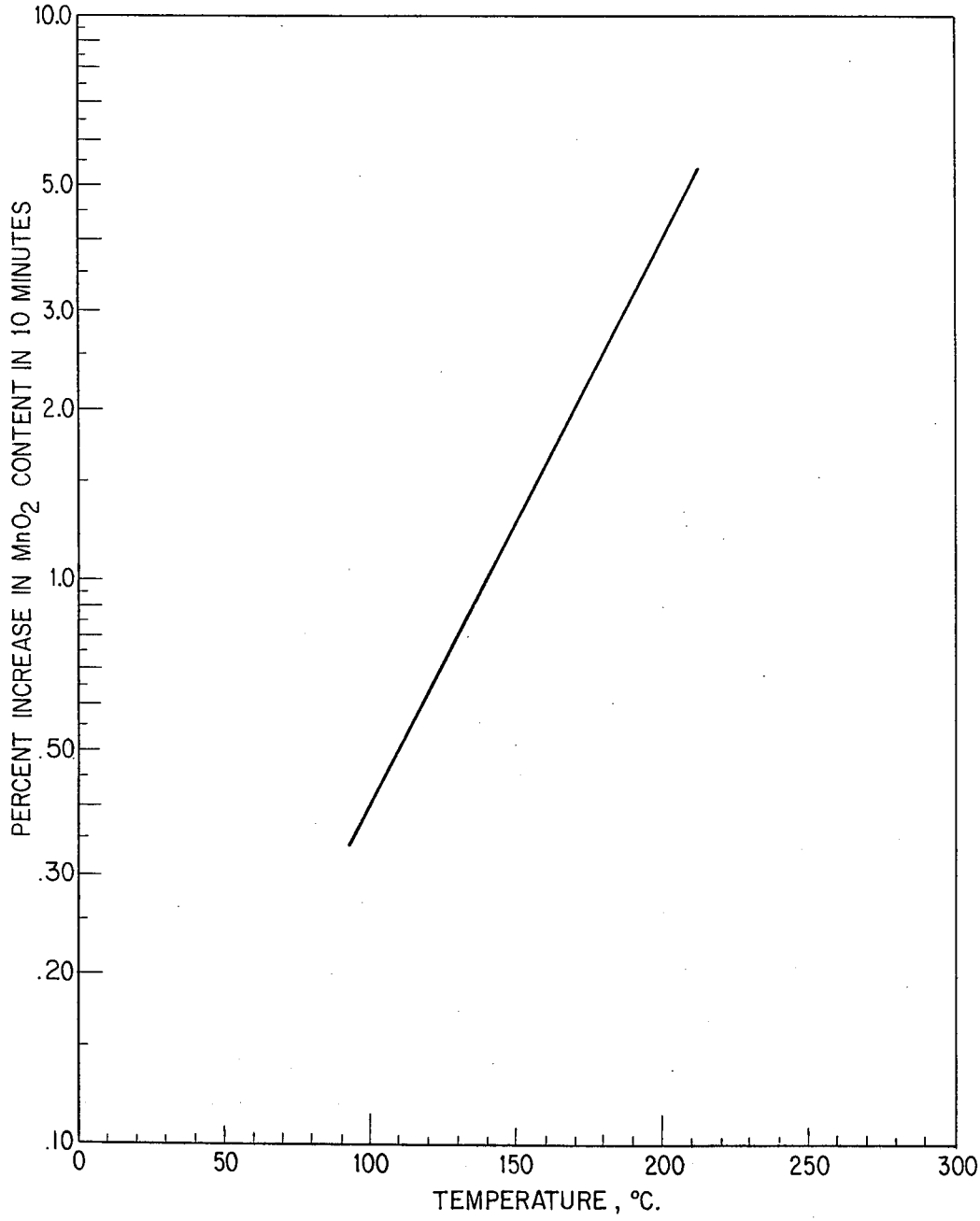
FIG. 1 is a graph showing that the logarithm of the increase in oxidation of reduced manganese ore per unit time is directly proportional to temperature.

Certain parameters of the process are interrelated and require coordination during operation. The basic relationships involved when using an air quench process are:

A. The rate of oxidation (or reoxidation) of MnO in air varies exponentially with temperature within the temperature range of interest (from about 90° to 230°C.). This is set forth in FIG. 1, where the percent increase in $MnO_2$ content of a Comolog type ore having a particle size predominantly between 0.25 mm (60 mesh) and 0.074 (200 mesh) is plotted on a logarithmic scale against temperature. The data indicates that the rate of oxidation approximately doubles with each increase of 36°C. (65°F.) in temperature.

Figure 2:
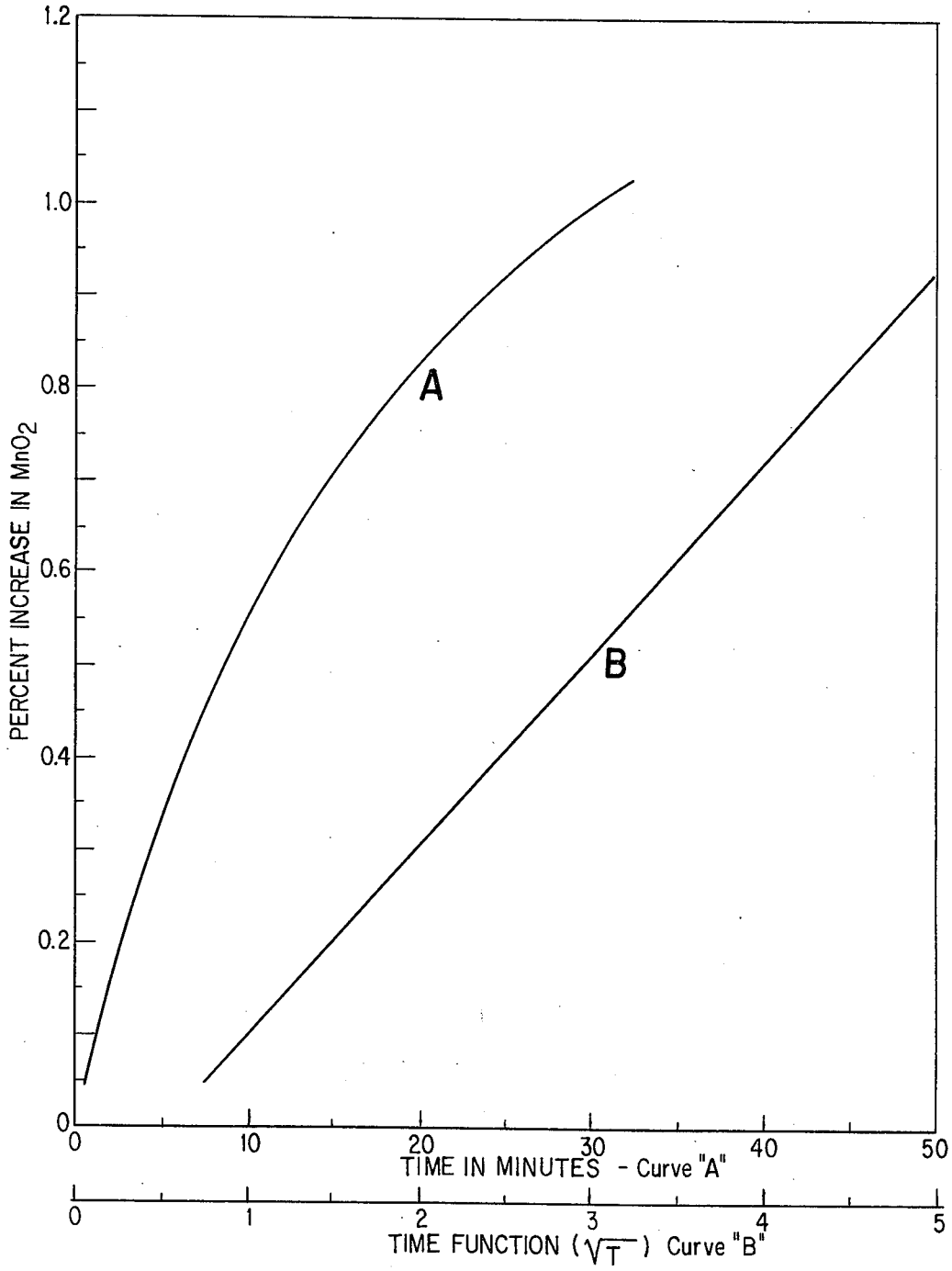
FIG. 2 is a graph correlating the increase in oxidation of reduced manganese ore directly with time ($t$) and also as a $\sqrt{t}$ function.

B. The degree of oxidation (or reoxidation) of MnO varies directly with the square root of time, or stated another way the rate of oxidation is directly proportional to the function $1/\sqrt{t}$ (other conditions constant). This is set forth in FIG. 2, where oxidation at 100°C. (212°F.) of a Comolog type ore having a paritcle size predominantly between 2.4 mm (8 mesh) and 1.0 mm (16 mesh) in an oxygen atmosphere is shown as a function of time.

These relationships, taken together, dictate the importance of coordinating the process conditions carefully during the first few seconds of air blow. This may be more clearly shown in terms of actual operation. For example, a layer of crushed reduced ore approximately 2.5 cm (1 inch) deep and 929 sq. cm. (1 sq. ft.) in cross section will have a mass of about 3860 grams. If it is assumed that about 5% (190 grams) of the crushed MnO consists of fines of 0.15 mm (100 mesh) and that the temperature of the mass is in the range 180°–205°C. (356°–401°F.), when the ore is placed on a screen and air is blown through it several competing processes occur simultaneously:

I. The ore begins to oxidize and generate heat. Each 2 grams of MnO ore will raise itself and 0.028 cubic meters (1 cubic foot) of air 36°C. (65°F.) as it oxidizes from MnO to $Mn_3O_4$.

II. The moving air removes sensible heat from the ore particles. Each 0.028 cubic meter of air raised 0.56°C. (1°F.) by sensible heat transfer will lower the temperature of 45 grams of ore by 0.56°C.

III. Some portion of the fine ore particles will be stripped from the bed and carried away in the moving air flow.

Experimental data have shown that air velocities of less than about 1.5 meters per second through a bed of this depth and temperature result in the ore becoming hot and oxidizing. It is apparent that process (I) is causing the ore to rise in temperature faster than process (II) can cool it. A very rapid snowballing effect can occur since each 36°C. rise in temperature doubles the rate of oxidation. The relationship of the rate of oxidation with time (rate $\propto 1/\sqrt{t}$) is compensating to a degree, since at a constant temperature the oxidation rate would be 1.4 times faster at the end of the first second as at the end of the second, 1.2 times faster at the end of the 2nd second as at the end of the third, and so on. However, it is clear that a relatively small increase in temperature can continue to overpower the effect of decreasing oxidation rate with time.

At air velocities through such a bed from about 1.5 meters (4.9 feet) per second to about 2.3 meters (7.5 feet) per second, experimental tests showed that the coarser ore particles in the bed were cooled with little or no oxidation, while the ore fines carried out of the bed with the air flow continued to oxidize and generate a high temperature exit gas stream. Under these conditions it is apparent that, for the coarse ore fraction, process (I) is overpowered by process (II). Coupled with the oxidation rate/time relationship this brings about very rapid cooling of the coarser ore with almost no oxidation. On the other hand the fines are moving with the air which limits the cooling of the individual particles, while at the same time the heat content of the composite air/fines mass can continue to build. The heat of oxidation of MnO to $Mn_3O_4$ is such that 2 grams of MnO ore can raise the temperature of 0.028 cubic meters of air about 36°C. (65°F.). With the percentage of fines postulated it is likely that the dust loading of the first air through such a bed could be 1800 grams per cubic meter. Thus very high temperatures can result if the oxidation process overpowers the cooling process in the dust-laden air leaving the ore bed.

At air velocities of about 2.3 meters (7.5 feet) per second or higher, little or no oxidation takes place even in the case of air-borne fines. Under these velocity conditions the air picks up so little heat per unit volume in moving through the bed that cooling of the fines can take place with sufficient speed to quench the oxidation reaction. Since 0.028 cubic meters of air can remove 0.56°C. of sensible heat from 45 gm of fines for each 0.56°C. rise in air temperature, if the air emerges from the bed at a sufficiently low temperature (usually less than 77°C.) then oxidation rates can be rapidly reduced more than twofold even at the dust loadings postulated above. Subsequent dilution of the dust-laden air in the processing equipment results in complete quenching of the ore fines without oxidation.

The time required for complete cooling of reduced ore varies with the size of the largest ore particles. At proper air blow rates the time for cooling ore containing particles up to 6.4 mm (one-fourth inch) is about 1–2 minutes, and for ore containing particles up to 20 mm (three-fourths inch) the cooling time is about 2–4 minutes. The heat transfer during the latter stages of the cooling is lower and if desired can be carried out at much lower blow rates. During the final cooling stages a blow rate of 1 meter per second is usually quite adequate to overcome the reoxidation reaction. Alternatively, the ore bed thickness may be increased during the latter stages of the cooling, while maintaining a higher blow rate.

Experimental data indicate that about half of the heat is removed from the reduced ore during the first 30 seconds of air blow. Relating this to the conditions postulated previously, if an average change in temperature of the cooling air as it moves through the bed of 36°C. occurs (30° to 66°C.), the 3860 grams of ore would be cooled from 185° to 110°C. in 36 seconds at 1.5 meters per second velocity or 22 seconds at 2.3 meters per second velocity.

The preceding clarifies the controlling principles of the process. These principles had not heretofore been recognized by workers in the field of manganese ore reduction. Discovery of these principles has enabled the interrelationship of the cooling/reoxidation processes to be defined, and has allowed the operating parameters of an air blow cooling process to be developed. Operating parameters may be generally summarized as follows:

1. Bed thickness will determine the optimum air blow rate. Thicknesses greater than about 5 cm (2 inches) usually will require an undesirably high blow rate. A bed thickness on the order of 2.5 cm (1 inch) generally requires an air blow rate of about 2.4 meters (8 feet) per second for the first 5–10 seconds.

2. Particle size of the reduced ore will affect the blow rate to a lesser degree. Ore having a finer average particle size will require a somewhat high rate. Ore having a particle size up to about 32 mm (1¼ inch) is suitable, but ore having a particle size predominantly in the the range 1–20 mm (18 mesh-¾ inch) is preferred for most efficient operation of the process.

3. The air blow through the hot bed should go to full rate almost instantaneously. A few seconds of intermediate blow rate may initiate a runaway oxidation reaction.

4. The duration of the air blow will be determined by the final temperature desired for the coarsest fraction of the ore.

5. The lower the initial temperature of the reduced ore, the less critical parameters (1) through (3) become. Control of each of these parameters can be relaxed to some degree if the initial ore temperature is in the range of 90°–120°C. (194°–248°F.) rather than the 180°–230°C. (356°–446°F.) range, since the oxidation rate would be only about one-quarter as fast.

The process will be further described in terms of air blow cooling runs carried out on continuous type equipment. Hot reduced manganese ore was discharged from an indirectly cooled kiln onto a moving reciprocating screen. Discharge rate and screen speed were adjusted to achieve an ore bed of the desired thickness. The hot ore was carried by the screen directly into an enclosed chamber, and cooling air was directed upwardly through the screen. The enclosed chamber was divided into two sections, the first for a high velocity air blow and the second for a lower velocity air blow. Velocity in each section was controlled by adjustable dampers in the air inlet piping. A conventional power-driven blower provided the air blow. After passing through the screen and ore bed, the air was collected in an expansion chamber at the top of the enclosure and passed to conventional dust collecting equipment. The cooled ore was discharged from the end of the enclosure for further processing. The results of several runs are summarized in the following Table.

TABLE

| Run | Ore Type | Ore size (mm) | ORE FEED °C. | ORE FEED %$MnO_2$ | ORE FEED Rate—kg/hr. | ORE FEED Depth of Bed—cm. | AIR BLOW Initial m/sec. | AIR BLOW Final m/sec. | AIR BLOW °C. | PRODUCT °C. | PRODUCT $MnO_2$ |
|---|---|---|---|---|---|---|---|---|---|---|---|
| I | Australian | 6.4 & down | 205 | 1.0 | 1540 | 2.5 | 2.0 | 1.3 | 16 | 21 | 1.2 |
| II | Comolog | 19 & down | 177 | 1.0 | 1700 | 2.5 | 2.5 | 1.1 | 24 | 43 | 1.9 |
| III | Comolog | 19 & down | 138 | 1.0 | 2270 | 2.5 | 2.5 | 1.1 | 24 | 43 | 1.03 |

Although the process has been described with particular reference to a continuous operation, it is also adaptable for use as a batch process. In this type of operation particular care must be taken to insure that the air blow is applied immediately and at the proper velocity as soon as the ore batch is ready for cooling. Undue exposure of the hot ore to the open atmosphere prior to the air blow should be avoided.

The air blow cooling process may be used in conjunction with a wide variety of apparatus for continuous processing, including moving webs, belts, or vibrating screens. The equipment used for generating an air blow of the proper velocity is not critical, and many ordinary jets or blowers may be adapted to the process, using either ambient or artificially cooled air.

The air blow process may be used advantageously in conjunction with other cooling processes such as inert gas quenching or indirect kiln cooling. Use of combined cooling processes often results in a significant saving of overall cooling time, as well as increased throughput rates for the reduction furnaces.

The term mesh as used herein refers to a specified particle size determined by the use of U.S. Standard Sieve Series screens.

Thus it is apparent that there has been provided, in accordance with the invention, a process which fully satisfies the advantages set forth above. While the invention has been described with particular reference to specific embodiments thereof, it is evident that many alternatives, modifications, and variations will be apparent to those skilled in the art in light of the foregoing description. Accordingly it is intended to encompass all such alternatives, modifications, and variations as fall within the spirit and scope of the appended claims.

What is claimed is:

1. In a process for the cooling of hot reduced manganese ore, the improvement which comprises blowing air through a layer of hot manganous oxide ore at a velocity of at least 1 meter per second until the ore has reached the desired temperature.

2. The process described in claim 1 wherein the layer of reduced ore has a thickness of not more than 5 centimeters.

3. The process described in claim 1 wherein the layer of reduced ore comprises crushed, unground manganese ore having a particle size predominantly in the range of 1 to 20 mm.

4. The process described in claim 1 wherein the initial temperature of the reduced ore ranges from 90° to 230°C.

5. The process described in claim 1 wherein the final temperature of the cooled, reduced ore ranges from 25° to 65°C.

6. The process described in claim 1 wherein ambient air is blown through the layer of reduced ore.

7. The process described in claim 1 wherein cooled air is blown through the layer of reduced ore.

8. The process described in claim 1 wherein the layer of reduced ore comprises a moving bed.

9. The process described in claim 1 wherein the velocity of the air blow ranges from one to five meters per second.

10. A process for the cooling of unground, reduced manganese ore from the range of 90°–230°C. to the range of 25°–65°C. which comprises a. spreading the hot manganous oxide ore in a layer up to about 5 cm. in thickness, and b. blowing cooler air through the ore layer at a velocity of at least 1 meter per second until all of the ore has reached the desired temperature.

* * * * *